US006334818B1

(12) United States Patent
Cameron et al.

(10) Patent No.: US 6,334,818 B1
(45) **Date of Patent: *Jan. 1, 2002**

(54) GOLF CLUB HEAD WITH AN INSERT ON THE STRIKING SURFACE

(75) Inventors: Don T. Cameron, Carlsbad; August L. Slivnik, Vista, both of CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/235,806

(22) Filed: Jan. 22, 1999

Related U.S. Application Data

(63) Continuation-in-part of application No. 09/220,083, filed on Dec. 23, 1998, and a continuation-in-part of application No. 08/711,337, filed on Sep. 6, 1996, now Pat. No. 5,944,619.

(51) Int. Cl.[7] ..... A63B 53/04
(52) U.S. Cl. ..... 473/332; 473/342
(58) Field of Search ..... 473/332, 342; 273/78

(56) References Cited

U.S. PATENT DOCUMENTS

| | | | |
|---|---|---|---|
| 572,436 | A | 12/1896 | Mills |
| 819,900 | A | 5/1906 | Martin |
| 873,423 | A | 12/1907 | Govan |
| 922,444 | A | 5/1909 | Youds |
| 1,046,343 | A | 12/1912 | Smith |
| 1,094,599 | A | 4/1914 | Samson |
| 1,253,700 | A | 1/1918 | McLaughlin |
| 1,359,220 | A | 11/1920 | Beamer |
| 1,383,654 | A | 7/1921 | Mattern |
| 1,562,956 | A | 11/1925 | Guerne |
| 1,617,090 | A | 2/1927 | Worthington |
| 1,840,451 | A | 1/1932 | Jansky |
| 1,854,548 | A | 4/1932 | Hunt |
| RE19,178 | E | 5/1934 | Spiker |
| 1,968,626 | A | 7/1934 | Young |
| 1,968,627 | A | 7/1934 | Young |
| 2,034,936 | A | 3/1936 | Barnhart |
| 2,056,335 | A | 10/1936 | Wettlaufer |

(List continued on next page.)

FOREIGN PATENT DOCUMENTS

| | | |
|---|---|---|
| AU | 266320 | 10/1994 |
| GB | 18134 | 7/1903 |
| GB | 854747 | 11/1960 |
| JP | 06-091021 A | 4/1994 |

OTHER PUBLICATIONS

Co–pending design patent application ser. No. 29/098,297 filed Dec. 23, 1998; entitled: "Golf Club Head with an Insert on the Striking Surface".
Pending utility patent application ser. No. 09/001,812 filed Dec. 31, 1997, entitled: "Golf Club Head with a Strike Face Having a First Insert within a Second Insert".
Golf Digest; Jul. 1973, Advertisement for "The Solid Ones".
Golf Digest; Jan. 1980, Advertisement for "80 Honeycomb li"; col. 3,4$^{th}$ Club Set.
Golf Equipment Universal Catalogue; 1995, "Grass Hunter Golf Clubs", p. 448.

* cited by examiner

*Primary Examiner*—Mark S. Graham
(74) *Attorney, Agent, or Firm*—Pennie & Edmonds LLP

(57) ABSTRACT

A golf club head has a strike face and an opposite back face portion. The strike face defines a recess having a bottom surface and a side wall surface extending between the bottom surface and the strike face. An insert is disposed within the recess. The insert has two portions. The first portion has a passageway extending from a front surface of the insert to a back surface of the insert, and the second portion forms a portion of the strike face. The insert is configured so that the passageway is spaced from the strike face. A vibration dampening material is disposed within the passageway.

26 Claims, 15 Drawing Sheets

U.S. PATENT DOCUMENTS 2,429,351 A 10/1947 Fetteroff
2,463,798 A 3/1949 Paisley
2,592,013 A 4/1952 Curley
2,846,228 A 8/1958 Reach
2,880,002 A 3/1959 Wetty
3,134,596 A 5/1964 Boznos
3,172,667 A 3/1965 Baker et al.
3,211,455 A 10/1965 Hyden
3,218,072 A 11/1965 Burr
3,220,733 A 11/1965 Saleeby
3,233,905 A 2/1966 Flom
3,333,854 A 8/1967 White
3,547,445 A 12/1970 Hardesty
3,695,618 A 10/1972 Woolley et al.
3,817,522 A 6/1974 Simmons
3,819,180 A 6/1974 Murphy
3,863,932 A 2/1975 Lezatte
D234,608 S 3/1975 Raymont et al.
3,975,023 A 8/1976 Inamori
3,989,248 A 11/1976 Campau
4,121,832 A 10/1978 Ebbing
4,156,526 A 5/1979 Huggins et al.
4,193,601 A 3/1980 Reid, Jr. et al.
4,194,739 A 3/1980 Thompson
4,195,842 A 4/1980 Coleman
4,199,144 A 4/1980 Skelly
4,213,613 A 7/1980 Nygren
4,325,553 A 4/1982 Taylor
D271,317 S 11/1983 Bretl
4,422,638 A 12/1983 Tucker
4,540,178 A 9/1985 Johnson et al.
4,573,685 A 3/1986 Young, IV et al.
4,618,149 A 10/1986 Maxel
4,679,792 A 7/1987 Straza et al.
4,681,322 A 7/1987 Straza et al.
4,697,814 A 10/1987 Yamada
D294,617 S 3/1988 Perkins
4,730,830 A 3/1988 Tilley
4,749,197 A 6/1988 Orlowski
4,792,140 A 12/1988 Yamaguchi et al.
4,804,188 A 2/1989 McKee et al.
4,811,950 A 3/1989 Kobayashi
4,812,187 A 3/1989 Honma
4,881,739 A 11/1989 Garcia
4,883,275 A 11/1989 Boone
4,884,808 A 12/1989 Retzer
4,928,965 A 5/1990 Yamaguchi et al.
4,930,781 A 6/1990 Allen
4,934,703 A 6/1990 Delaney
4,941,666 A 7/1990 Suganuma
5,004,242 A 4/1991 Iwanaga et al.
5,016,883 A 5/1991 Kobayashi
5,060,951 A 10/1991 Allen
5,064,197 A 11/1991 Eddy
5,078,397 A 1/1992 Aizawa
5,078,398 A 1/1992 Reed et al.
5,082,278 A 1/1992 Hsien
5,083,778 A 1/1992 Douglass
5,141,231 A 8/1992 Cox
5,143,571 A 9/1992 Lacoste et al.
5,154,425 A 10/1992 Niskanen et al.
5,198,062 A 3/1993 Chen
5,219,408 A 6/1993 Sun
5,221,087 A 6/1993 Fenton et al.
5,271,622 A 12/1993 Rogerson
5,290,036 A 3/1994 Fenton et al.
5,299,807 A 4/1994 Hutin
5,301,941 A 4/1994 Allen
5,303,922 A 4/1994 Lo
5,332,214 A 7/1994 Tucker, Sr.
5,333,871 A 8/1994 Wishon
5,342,052 A 8/1994 Costa
D350,582 S 9/1994 Mansian et al.
5,346,213 A 9/1994 Yamada
5,348,302 A 9/1994 Sasamoto et al.
D351,443 S 10/1994 Caugh et al.
5,354,059 A 10/1994 Stuff
5,362,055 A 11/1994 Rennie
5,385,348 A 1/1995 Wargo
D356,131 S 3/1995 Trimble
5,398,929 A 3/1995 Kitaichi
5,403,007 A 4/1995 Chen
5,405,137 A 4/1995 Vincent et al.
5,407,202 A 4/1995 Igarashi
5,425,535 A 6/1995 Gee
5,429,354 A 7/1995 Long et al.
5,431,396 A 7/1995 Shieh
5,433,440 A 7/1995 Lin
5,437,447 A 8/1995 Rigutto
5,447,311 A 9/1995 Viollaz et al.
5,458,332 A 10/1995 Fisher
5,472,201 A 12/1995 Aizawa et al.
5,497,993 A 3/1996 Shan
5,509,660 A 4/1996 Elmer
5,529,543 A 6/1996 Beaumont, Sr.
D373,161 S 8/1996 Schmidt et al.
5,575,472 A 11/1996 Magerman et al.
5,601,501 A 2/1997 Kobayashi
5,603,667 A 2/1997 Ezaki et al.
D385,609 S 10/1997 Cameron
5,674,132 A 10/1997 Fisher
5,676,605 A 10/1997 Kobayashi
D385,935 S 11/1997 Cameron
5,690,562 A 11/1997 Sturm
D389,207 S 1/1998 Cameron
5,707,302 A 1/1998 Leon et al.
5,713,800 A 2/1998 Su
5,735,755 A 4/1998 Kobayashi
5,766,093 A 6/1998 Rohrer
5,766,094 A 6/1998 Mahaffey et al.
5,772,527 A 6/1998 Liu
D397,752 S 9/1998 Cameron
6,045,456 A * 4/2000 Best et al. ..... 473/332

GOLF CLUB HEAD WITH AN INSERT ON THE STRIKING SURFACE

This application is a continuation in part of application Ser. No. 09/220,089, filed Dec. 23, 1998, and a continuation-in-part of application Ser. No. 08/711,337, filed Sep. 6, 1996, U.S. Pat. No. 5,944,619 the disclosure of which is incorporated by reference in its entirety.

TECHNICAL FIELD

The present invention relates to golf clubs and, more particularly, to a golf club that has an insert on the strike surface of the club.

BACKGROUND OF THE INVENTION

Golf clubs have long been developed to improve the "touch and feel" of the club, most particularly with, but not limited to, the clubs used on and around the green. One approach to improve the touch and feel of a club is to modify either the grip, the shaft, or the strike face of the golf club. For example, modifications to the club head could include an insert that is placed on the club strike surface to affect the impact of the club with the golf ball and to improve the feedback to the golfer after impact.

It is desired that the present invention provided an improved golf club head with better touch and feel as a result of modifying the strike face of the golf club head.

SUMMARY OF THE INVENTION

An object of the present invention is to provide a golf club with an improved "touch and feel" on and around the green.

Another object of the present invention is to provide a golf club with an insert on the strike face that affects the rebound of the golf ball at impact with the strike face.

Another object of the present invention is to provide a golf club that dampens vibrations and improves the feedback to the golfer at impact of the golf club with the golf ball.

The present invention includes a golf club head having a toe and an opposite heel, a sole portion and an opposite top portion, a forwardly facing exposed strike face and an opposite rearwardly facing exposed back face portion. The club head includes a recess in the strike face, an insert disposed within the recess, and a vibration dampening material that extends continuously from the strike face to the back face portion. In one embodiment, the vibration dampening material extends through the insert.

According to another embodiment of the present invention, a golf club includes a strike surface and an opposite back face portion. The strike face includes a recess with a bottom surface and a side wall surface. The club head further includes an insert which is disposed in the recess. The insert has a first portion, a second portion, and a back face. The first portion includes a front surface spaced from the strike face, and a first passageway extending from the upper surface to the back face of the insert. The second portion forms a portion of the strike face. A vibration dampening material is located in the first passageway.

In one embodiment, the insert is configured so that it has a peripheral edge spaced from the side wall surface to form a peripheral groove on the strike face, and the vibration dampening material located in the groove.

In another embodiment the club head further includes first apertures that extend from the back face portion to the bottom surface, and the vibration dampening material is located in the first aperture.

In yet another embodiment, the first passageway further includes second apertures through the first portion of the flange and a cutout extending between the second apertures into at least partial alignment with the first apertures.

Thus, the present invention provides a club head with an insert and vibration dampening material that is continuous from the strike face to the back face portion.

The configuration of the insert and club head vary the amount of vibration dampening material within the club to vary the feel of the club.

DETAILED DESCRIPTION OF THE INVENTION

Figure 1:
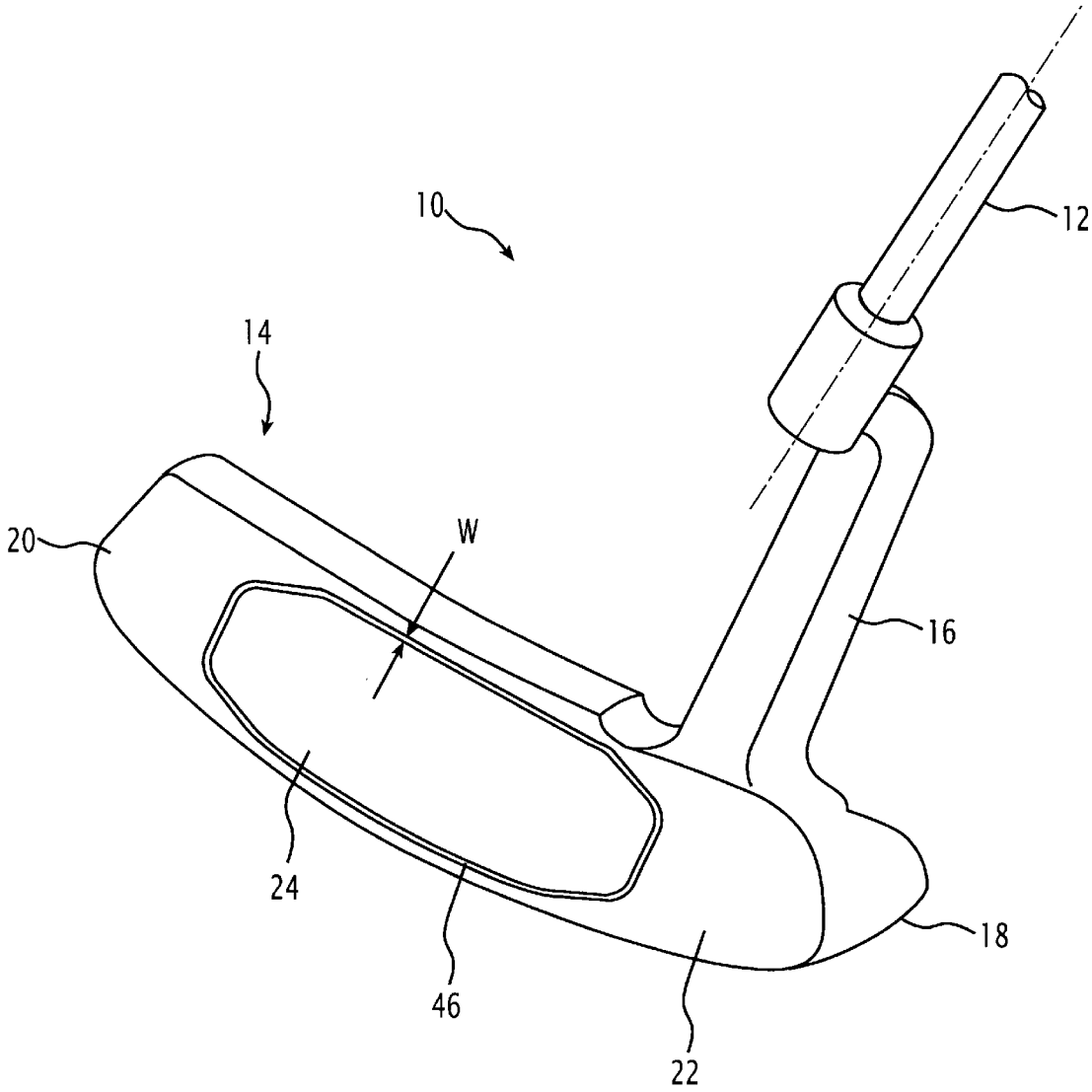
FIG. 1 is a front perspective view of a golf club head of the present invention showing an insert located on a strike face with a vibration dampening material there around.
Figure 2:
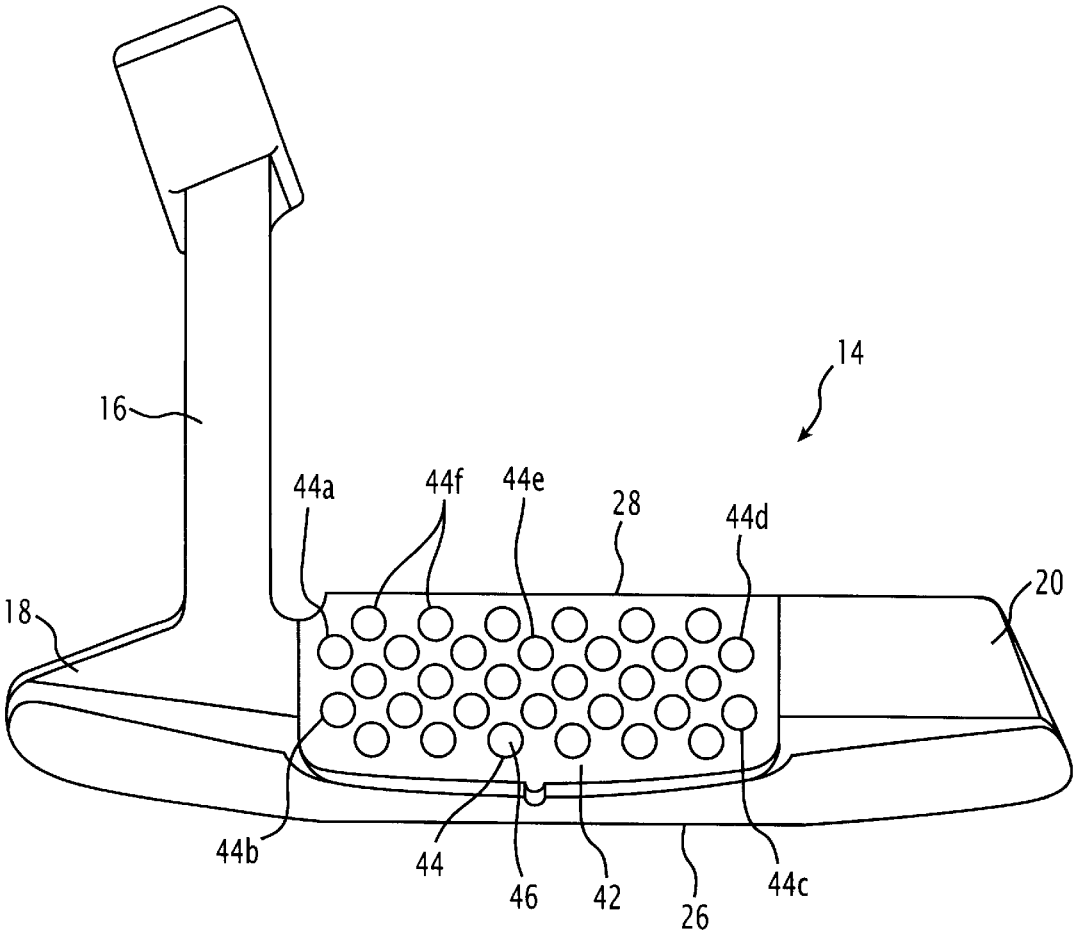
FIG. 2 is a rear view of the golf club head of FIG. 1 showing a plurality of apertures spaced apart on a back face of a club head with the vibration dampening material within the apertures.

According to the present invention and referring to FIGS. 1 and 2, a golf club 10 has a shaft 12 (only partially shown) attached to a club head 14. A putter-type club head is shown in FIG. 1. The club head 14 has a hosel 16 that accepts the shaft 12 with a heel 18 at the hosel end of the club head 14 and a toe 20 opposite of the heel 18. The club head 14 also has a sole portion 26 and an opposite top portion 28. Extending between the heel 18 and the toe 20 is a strike face 22, which is the surface that contacts the golf ball (not shown) upon impact between the golf club 10 and the ball. The strike face 22 includes a "sweet spot," or the center of gravity in the toe to heel direction, which is covered with an insert 24. The insert 24 is made of a material that is different than the rest of the club head. In the preferred embodiment, the insert is made of a tellurium copper alloy, which is a relatively soft alloy that improves the touch and feel of the club. In the preferred embodiment, the tellurium copper alloy includes a minimum of 99.4% copper, a maximum of 0.004–0.012 ppm of phosphorus and a maximum of 0.4–0.7 ppm of tellurium, and has a hardness of approximately 80 HB.

Figure 3:
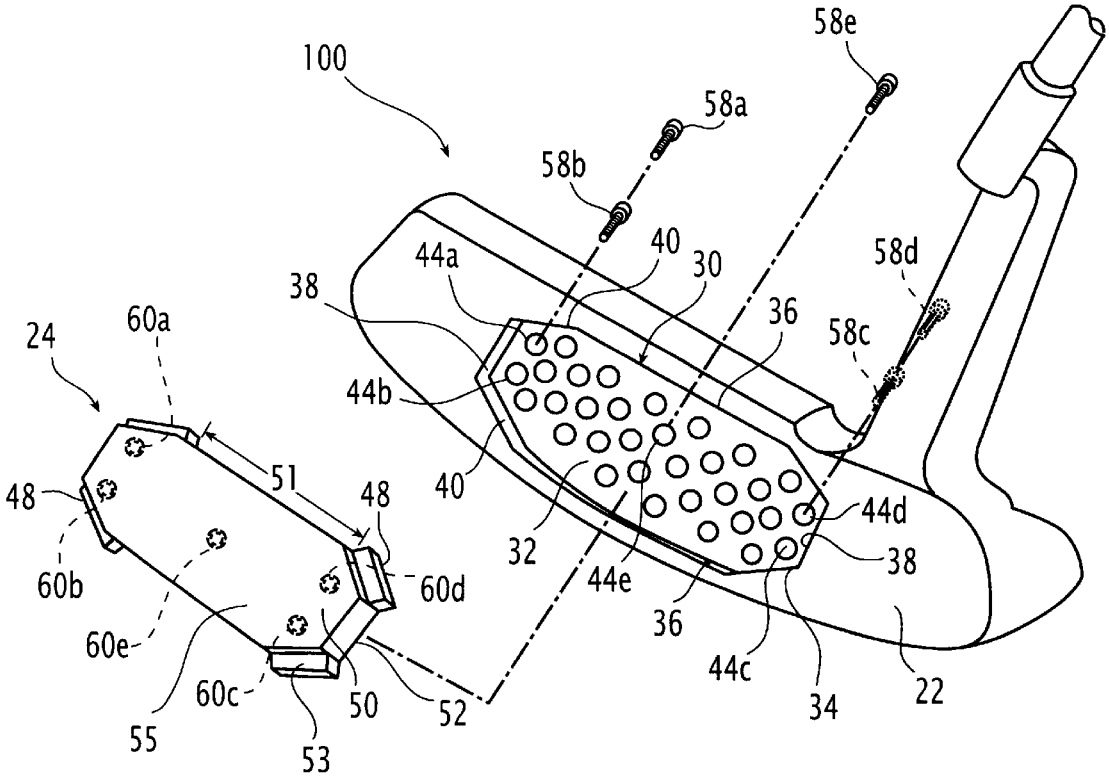
FIG. 3 is an exploded front perspective view of the golf club head shown in FIG. 1 showing the club head before assembly.

Referring to FIG. 3, the strike face 22 defines a recess 30 having a bottom surface 32 and a side wall surface 34 surrounding the bottom surface 32. The side wall surface 34 includes a plurality of portions 36–40. The pair of horizontal side wall portions 36 are substantially parallel to one another, and generally horizontal. The pair of vertical side wall portions 38 are substantially parallel to one another, and generally vertical. The four corner side wall portions 40 extend between adjacent horizontal and vertical side wall portions to form angled surfaces.

As shown in FIG. 2, the club head 14 has an essentially flat back face portion 42 that extends partially between the heel 18 and the toe 20 and partially between the top portion 28 and the sole portion 26. The back face portion 42 has a plurality of apertures 44 that are preferably evenly spaced apart in relation to each other. The apertures also follow the contour of the back face portion 42 and are essentially perpendicular to the strike face 22 (as shown in FIG. 1).

Turning to FIG. 3, the apertures 44 extend from the back face 42 toward the insert 24. Preferably more than five apertures are used, more preferably there are greater than 20 apertures, and most preferably there are 32 apertures. A vibration dampening material 46, such as an elastomeric material, that is deformable is located in each aperture 44. In the preferred embodiment, which will be described in detail below, the elastomeric material is a silicone material, Stock No. GE281, available from General Electric Company in Waterford, N.Y.

Referring to FIG. 3, the integrally formed insert 24 includes a first portion or projections 48 and a second or platform portion 50. The projections 48 are spaced apart and extend radially outwardly from the platform portion 50. The projections 48 define the spaces 51 there between. The insert 24 further includes a back face 52. Each projection 48 includes a front surface 53 spaced from the front surface 55 of the platform portion 50. The projections 48 are sized to fit within the recess 30. When the insert 24 is inserted in the recess 30, the back face 52 is in contact with the bottom surface 32 of the recess 30.

Figure 4:
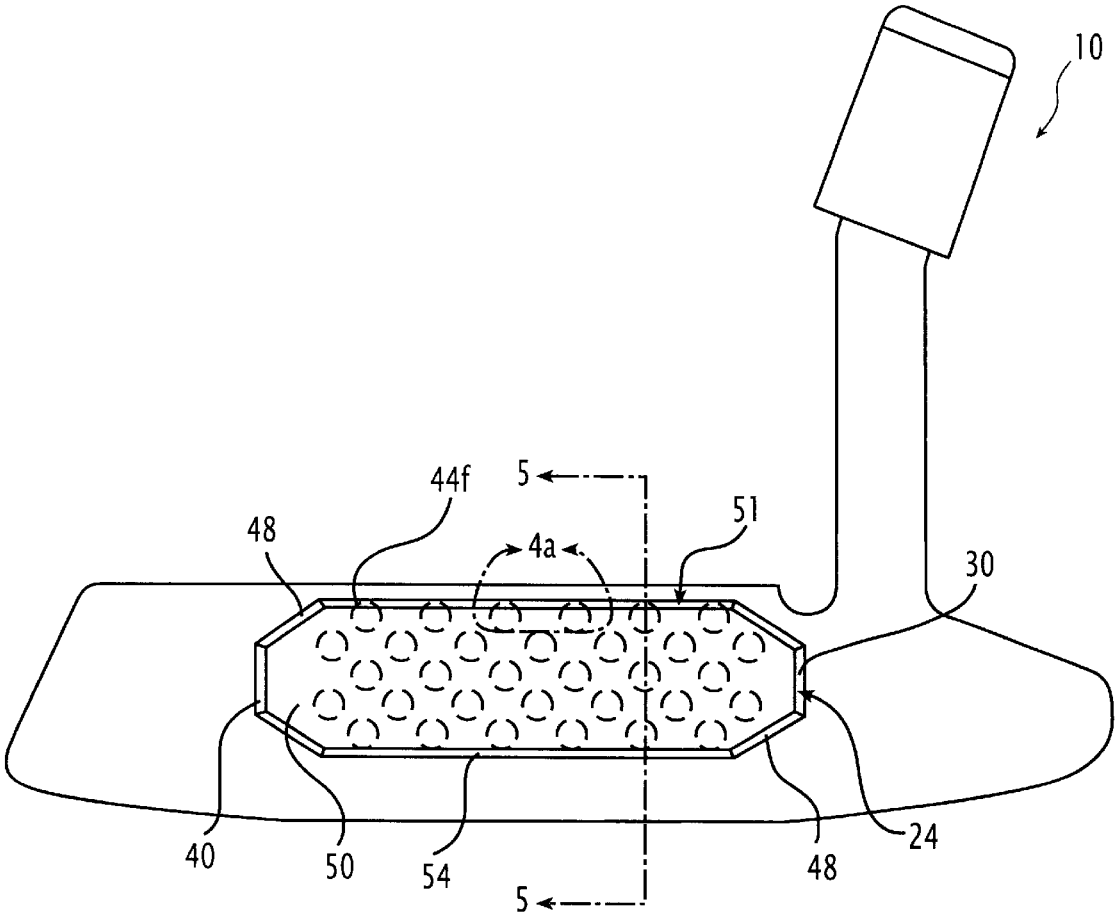
FIG. 4 is a front view of the club head of FIG. 3, showing the club head after assembly but prior to injecting the vibration dampening material therein.
Figure 5:
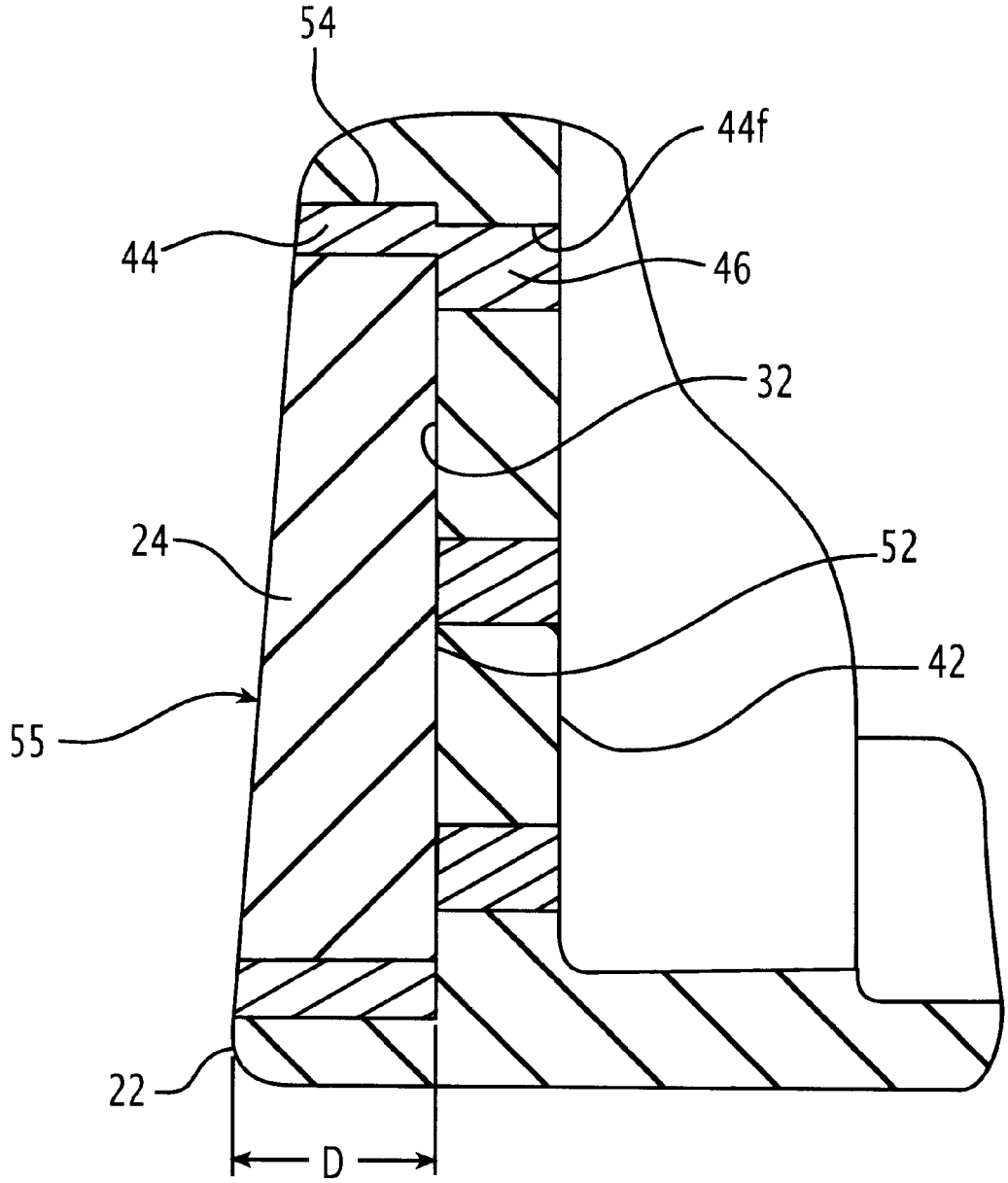
FIG. 5 is a cross-sectional view taken from line 5—5 of FIG. 4 showing the golf club head with the vibration dampening material therein.

Furthermore, the projections 48 are disposed adjacent and in contact with the bottom surface 32 and the side wall surface portions 36–40. In the installed position, the platform portion 50 includes an outer peripheral edge, which is spaced from at least a portion of the side wall surface, to define a peripheral groove 54 (as shown in FIGS. 3–5) between the platform portion 50 and the side wall surfaces 36–40. The projections 48 center the insert within the recess. The peripheral groove 54 surrounds the platform portion 50 of the insert. The groove has a width, designated by the arrow w in FIG. 1.

Referring now to FIGS. 2–4, the apertures 44*a–e* receive a fastening means 58*a–e*. The outermost apertures 44*a–d* has complementary counterbores. The aperture 44*e* is a central aperture that receives a center fastener 44*e*. The insert back face 52 includes five threaded holes 60*a–e* (shown in phantom) that are complimentary to the apertures 44*a*–44*e* in the club head 10. The five fasteners 58*a*–58*e* are fastened into the insert holes 60*a–e*. The fasteners 58*a–e* connect the insert 24 to the club head.

During machining of the loft in the putter, the fasteners aid in maintaining the connection between the insert and the club head. After machining, the center fastener 58*e* is removed from the insert hole 44*e*. The purpose of the center fastener 44*e* is to aid in maintaining the connection between the insert and the club head during machining.

Figure 4A:
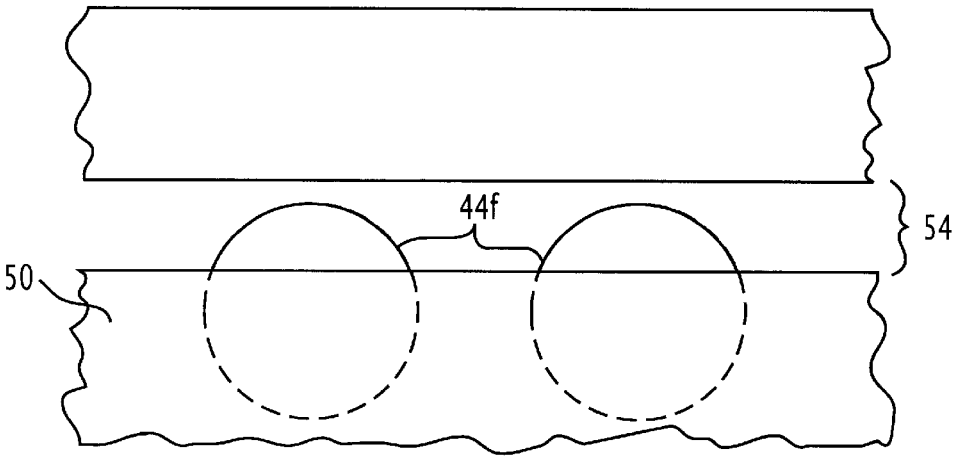
FIG. 4A is an enlarged partial front view of the portion of the club head within the circle 4A—4A of FIG. 4.

Referring to FIG. 4, the top row of apertures are designated 44*f*. When the insert 24 is disposed within the recess 30, the aperture or space 51 between the projections 48 is located so that it is partially aligned with the top row of apertures 44*f*. As a result, as best shown in FIG. 4A, a portion of the top row apertures 44*f* are visible from the front of the club head within the groove 54 before the vibration dampening material is disposed within the club head. The portion of the apertures (shown in phantom) are covered by the platform portion 50 of the insert.

As shown in FIGS. 4 and 5, once the vibration dampening material is disposed in the groove 54 and the apertures 44 and the space 51 provides a passageway for allowing the elastomeric material in the groove 54 to be in fluid communication with the elastomeric material in the apertures 44. Thus, the vibration dampening material is continuous from the strike face 22 to the back face portion 42.

Referring to FIGS. 3 and 5, also when the insert 24 is within the recess 30, the front surface 53 of the projections 48 is spaced from the strike face 22 and the front surface 55 of the platform portion 50 forms a portion of the strike face 22. As a result, the passageway in the insert is spaced from the strike face 22.

In this embodiment the top row of apertures are aligned with the spaces between the projections. In other embodiments, the insert can be configured so that, for example, the top row and the bottom row of apertures are partially or fully aligned with associated spaces between the projections.

The contact between the insert and the club head creates a metal-to-metal contact between the insert and the recess surfaces. The size of the apertures 44 and the volume of the elastomeric material 46 located in the apertures and the grooves and spaces combine to reduce the amount of metal-to-metal contact between the insert 24 and the recess surfaces. Therefore, the "touch and the feel" of the putter may be altered by varying the amount of metal-to-metal contact and by proportionately varying the amount of elastomeric material located around the insert.

Figure 6:
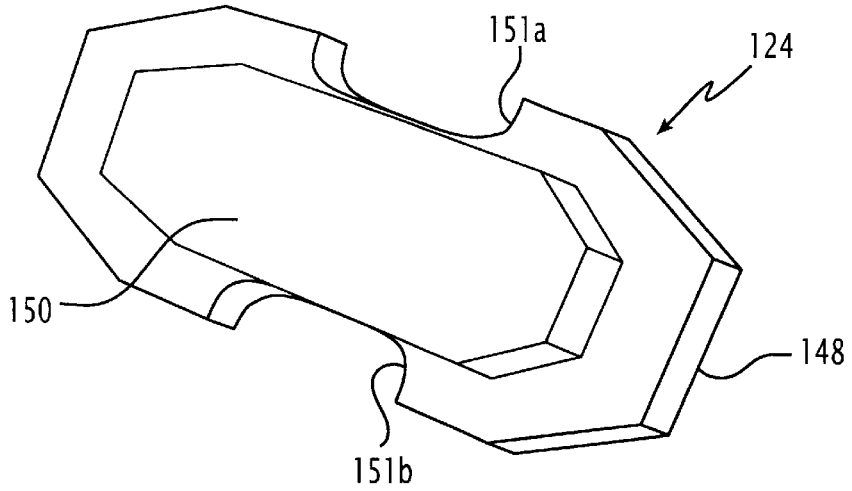
FIG. 6 is an enlarged, front perspective view of another embodiment of the insert for use with the club head of the present invention.

Referring to FIG. 6, the insert 124 has been modified to include a first portion which is a flange 148. The flange 148 extends radially outwardly from the platform portion 150. The flange is sized to fit within the recess 30 of the club head 10 shown in FIG. 7. This club head is similar to the club head discussed above. The insert 124 is fastened within the club head as discussed previously.

Figure 7:
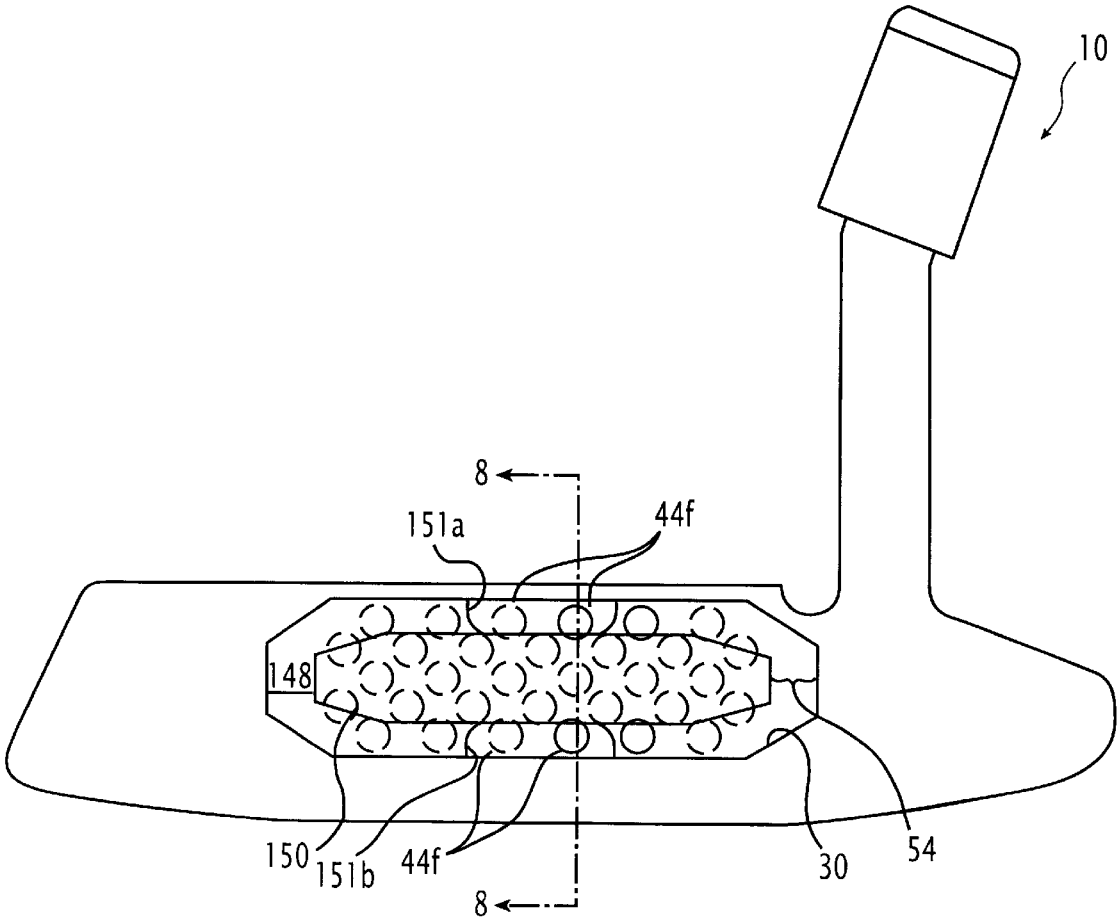
FIG. 7 is a front view of the club head of FIG. 6, showing the club head after assembly but prior to injecting the vibration dampening material therein.

Referring to FIG. 6, the flange 148 defines upper and lower notches or passageways 151*a* and *b*, respectively. Referring to FIG. 7, the notches 151*a* and *b* are sized so that when the insert 124 is disposed within the recess 30, a pair of the two center apertures 44*f* in the top and bottom rows of the apertures are completely aligned with the notches 151*a* and 51*b*.

Figure 8:
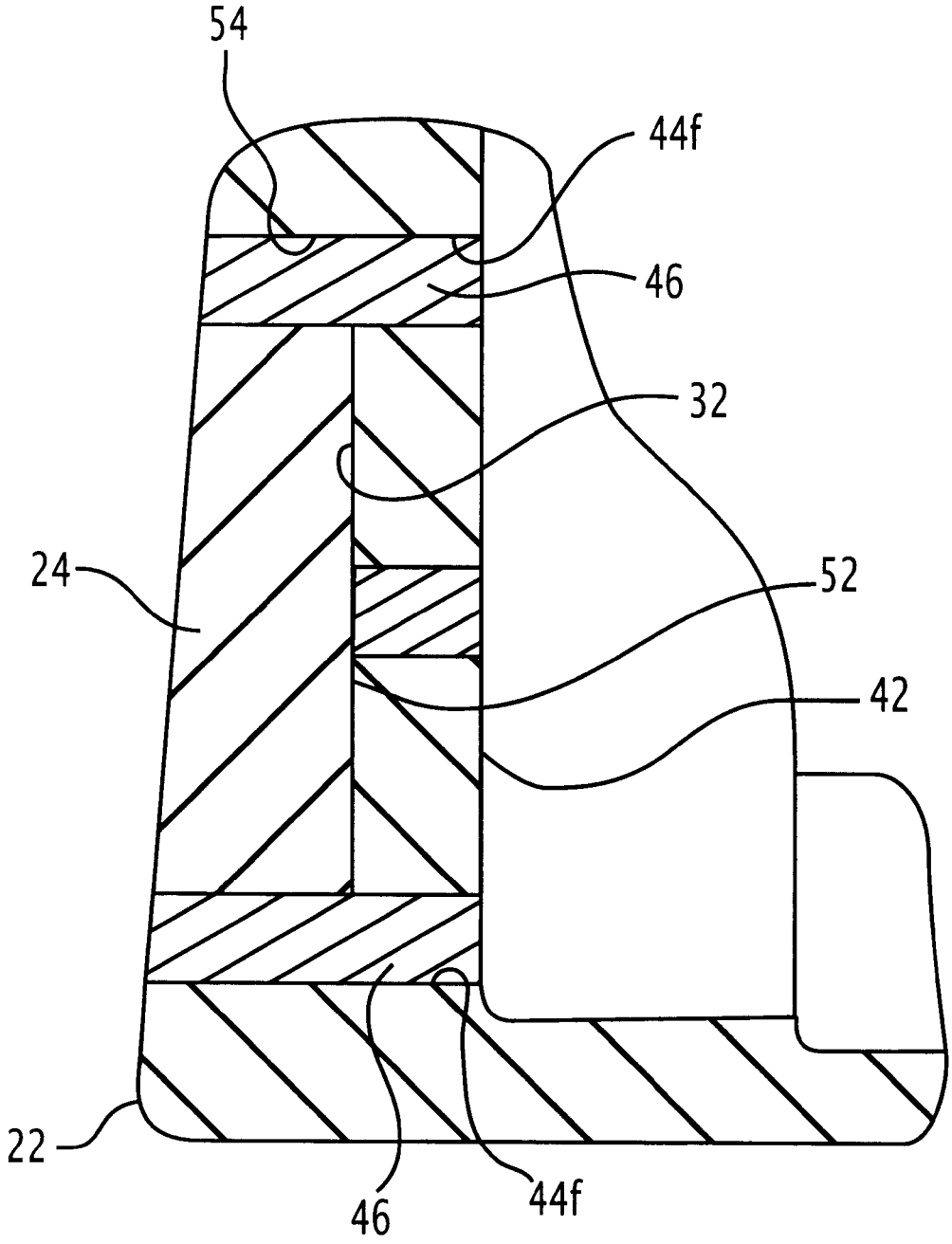
FIG. 8 is a cross-sectional view taken from line 8—8 of FIG. 7 showing the golf club head with the vibration dampening material therein.

Referring to FIG. 8, it is shown that by completely aligning the notches 151*a* and *b* with the holes 44*f* the vibration dampening material in the groove 54 is in fluid communication with the vibration dampening material in the apertures, and the vibration dampening material is continuous from the strike face 22 to the back face portion 42.

In this embodiment, the portion of the insert forming the apertures 151*a* and *b* is not in contact with the bottom surface 32 of the recess. The remaining portion of the back face 52 of the insert 124 is in contact with the bottom surface of the recess. The metal-to-metal contact of the insert and the recess surfaces is reduced by using the vibration dampening material.

In another embodiment, the flange can be configured so that the notches are partially aligned with various apertures in the club head. Furthermore, the shape, location, and number of the notches can be varied while still providing the passageway as desired.

Figure 6A:
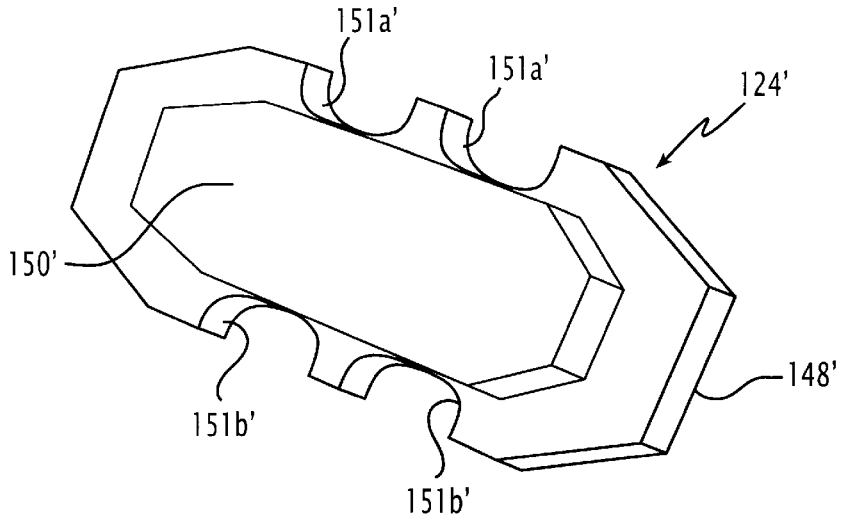
FIG. 6A is an enlarged, front perspective view of another embodiment of the insert for use with the club head of the present invention.

Referring to FIG. 6A, the insert 124' is similar to the insert 124 shown in FIG. 6, and similar features have the same reference numeral followed by a prime. The insert 124' has been modified to include a flange 148'. The flange 148' extends radially outwardly from the platform portion 150'. The flange is sized to fit within the recess 30 of the club head 10 shown in FIG. 7A. This club head is similar to the club head discussed above. The insert 124' is fastened within the club head as discussed previously.

Figure 7A:
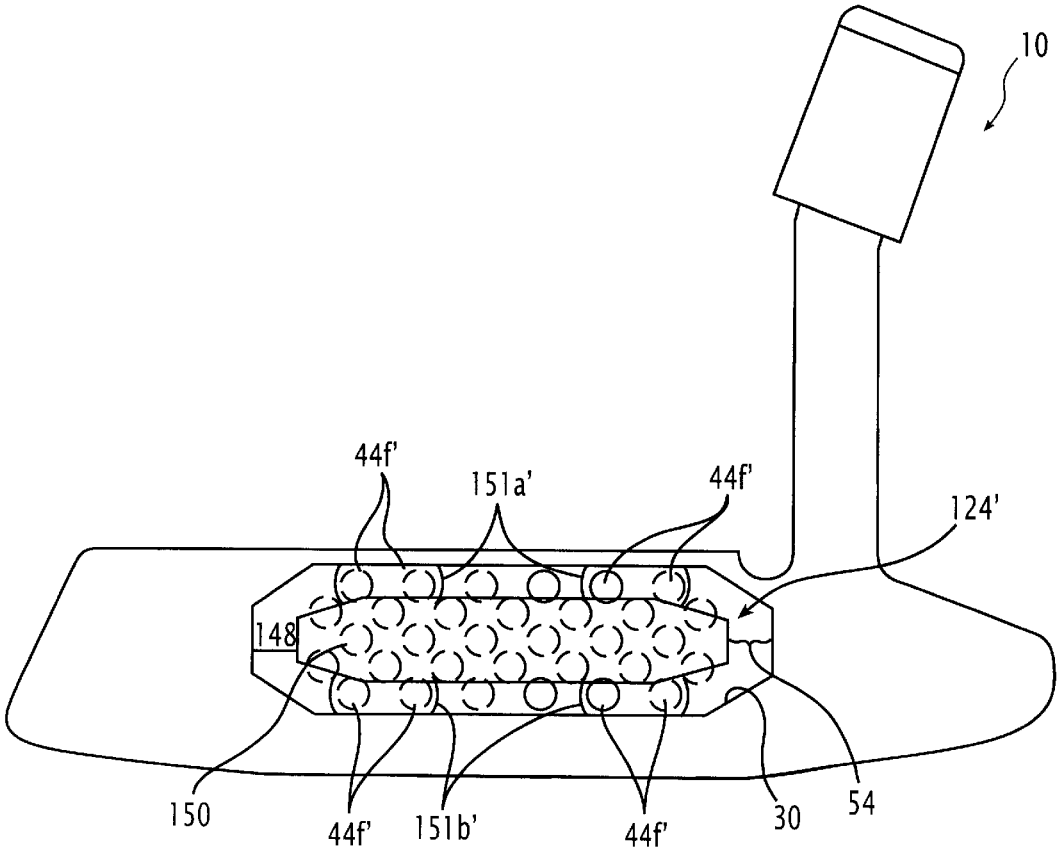
FIG. 7A is a front view of the club head of FIG. 6A, showing the club head after assembly but prior to injecting the vibration dampening material therein.

Referring to FIG. 6A, the flange 148' defines a pair of upper and lower notches or passageways 151*a* and *b*, respectively. Referring to FIG. 7A, the notches 151*a* and *b* are sized so that when the insert 124 is disposed within the recess 30, a pair of the apertures 44*f'* at the toe side 18 and a pair of the apertures 44*f'* at the heel side are completely aligned with the respective notches 151*a* and 51*b*. This embodiment allows metal-to-metal contact of the insert 124' with the bottom surface of the recess over the sweet spot and more vibration dampening toward the toe and heel. Thus, off-center hits should be provided more dampening.

Figure 9:
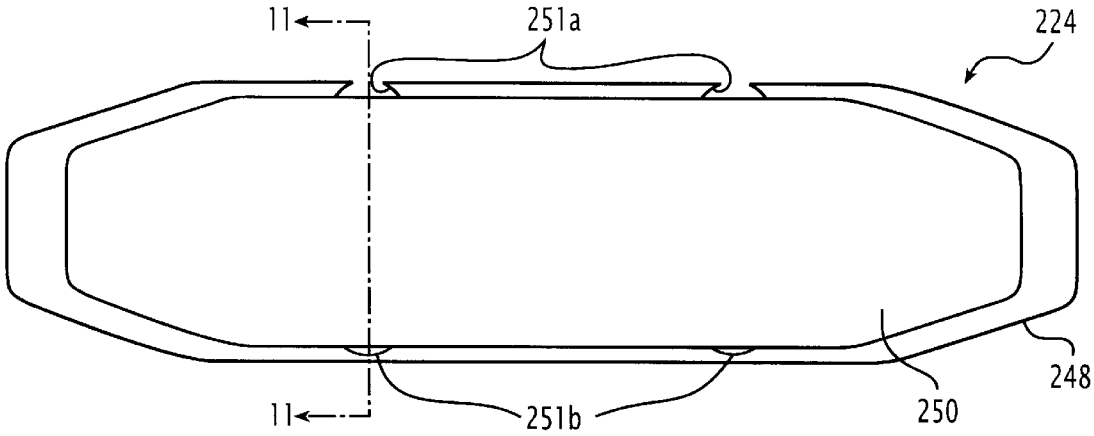
FIG. 9 is an enlarged, front view of a golf club head with the insert removed.

Referring to FIG. 9, the insert 224 has been modified and includes a first portion which is a flange 248. The flange 248 extends radially outwardly from the platform portion 250. The flange is sized to fit within the recess 30 of the club head 10 shown in FIG. 9A. The flange 248 defines a pair of upper and lower apertures 251*a* and *b*, respectively.

Figure 10:
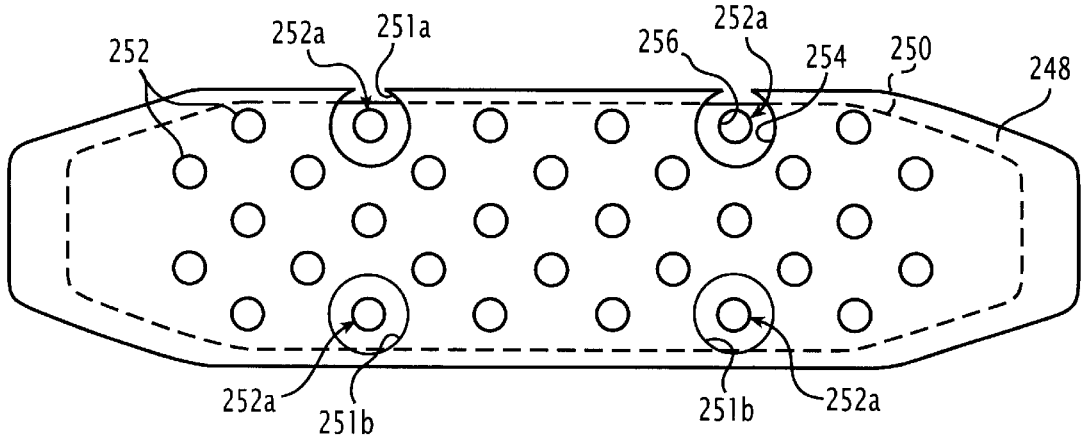
FIG. 10 is an enlarged, back view of the insert shown in FIG. 9.
Figure 11:
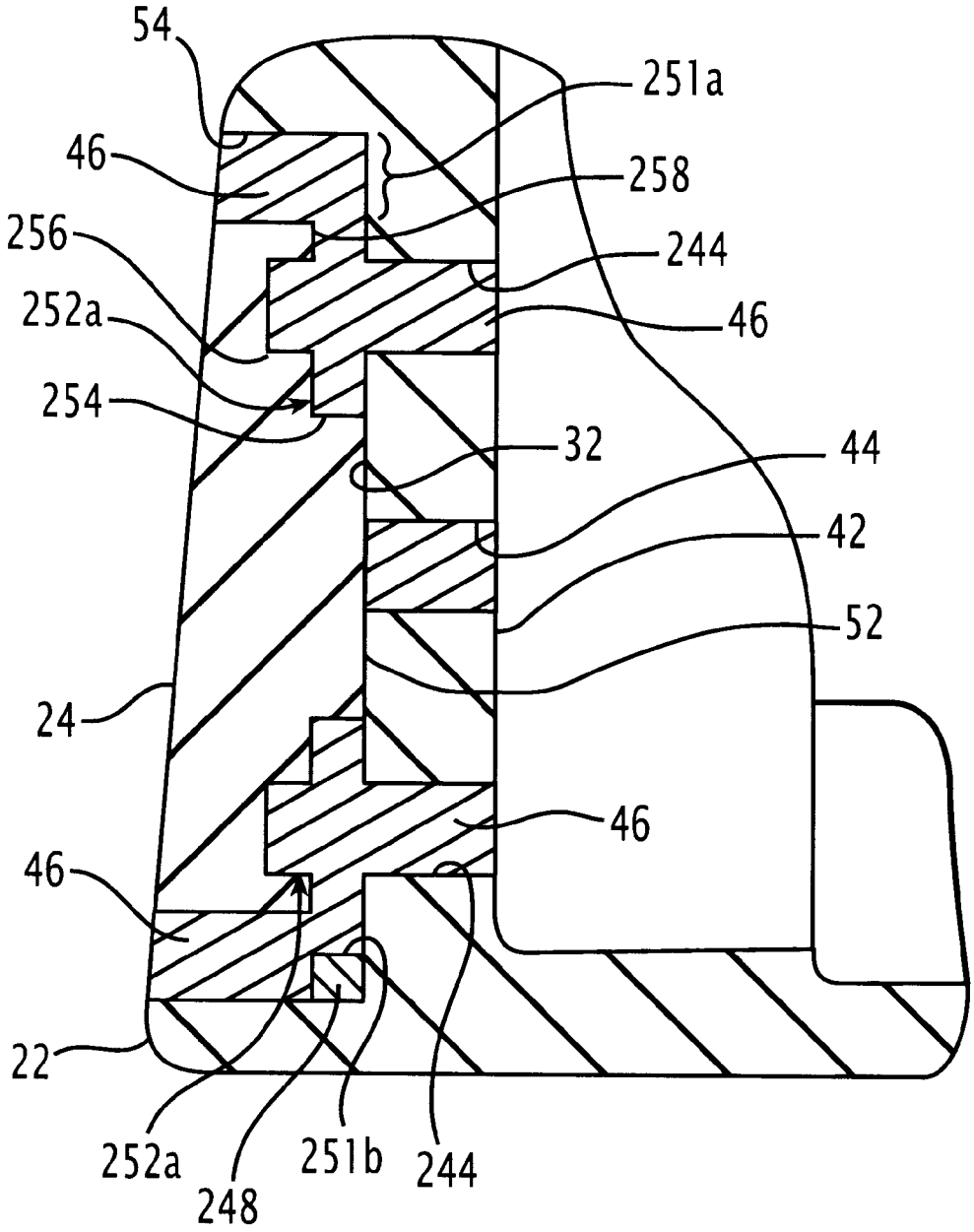
FIG. 11 is a cross-sectional view taken from line 11—11 of FIG. 9 showing the golf club head with the insert of FIGS. 9–10 and the vibration dampening material therein.

Referring to FIGS. 10 and 11, the back face 52 of the insert 224 further includes a plurality of cavities 252. The cavities 252 are aligned to be complementary with the apertures 44 and 244. Some of the apertures 44 receive the fasteners as previously discussed to secure the insert 224 to the club head.

Referring to FIGS. 10 and 11, four of the cavities 252*a* are formed so that they include a counterbored portion 254 and a reduced diameter portion 256. The counterbored portion 254 extends from the insert back face 52 to the reduced diameter portion 256. The counterbored portion 254 is configured so that it forms the apertures 251*a* and *b* and a cutout 258 extending between the apertures 251*a* and *b* and the reduced portion of the cavities 256. The cavities and counterbores which form the apertures 251*a* are located so that the apertures 251*a* are notches extending to the periphery of the flange. The cavities and counterbores which form the apertures 251*b* are located so that the apertures 251*b* extend through the flange spaced from the periphery of the flange.

Figure 9A:
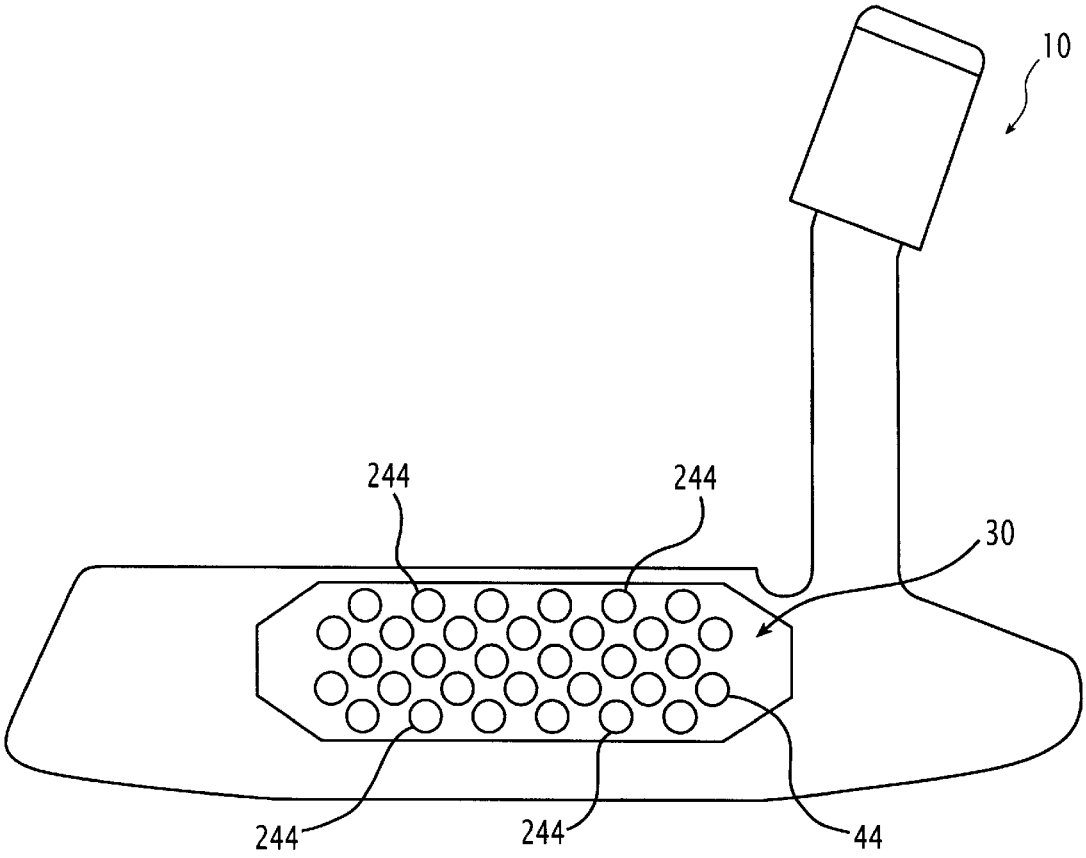
FIG. 9*a* is an enlarged, front view of another embodiment of the insert for use with the club head shown in FIG. 9A.

Referring to FIG. 9A, when the insert 224 is disposed within the recess 30, the cavities 252*a* are aligned with the apertures 244. As shown in FIG. 11, the passageway from the groove 54 to the apertures 244 is formed by each aperture 251*a* and *b* and the associated the counterbores 254. The vibration dampening material 46 is disposed within the groove 54, the apertures 251*a* and *b*, the cavities 252*a*, and the apertures 44 and 244. The vibration dampening material 46 in the apertures 244, and the vibration dampening material 46 is continuous from the strike face 22 to the back face portion 42.

In this embodiment, the portion of the insert forming the counterbores and cavities is spaced from the bottom surface 32 of the recess. The remaining portion of the insert 224 is in metal-to-metal contact with the bottom surface of the recess. The insert cavities 252 and 252*a* provide a more pronounced vibration dampening feature than the embodiment disclosed in FIGS. 3 and 6, since the amount of metal-to-metal contact will be decreased using the insert 224 versus the inserts 24 and 124. This results from the elastomeric material 46 extending into the back face 52 of the insert 224 due to the cavities. So the elastomeric material encompasses more area on the back face of the insert 224.

In another embodiment, the back face of the insert can be modified so that the cutouts have a different shape. Furthermore, the location and number of the apertures and cavities can be varied while still providing the passageway as desired.

Figure 12:
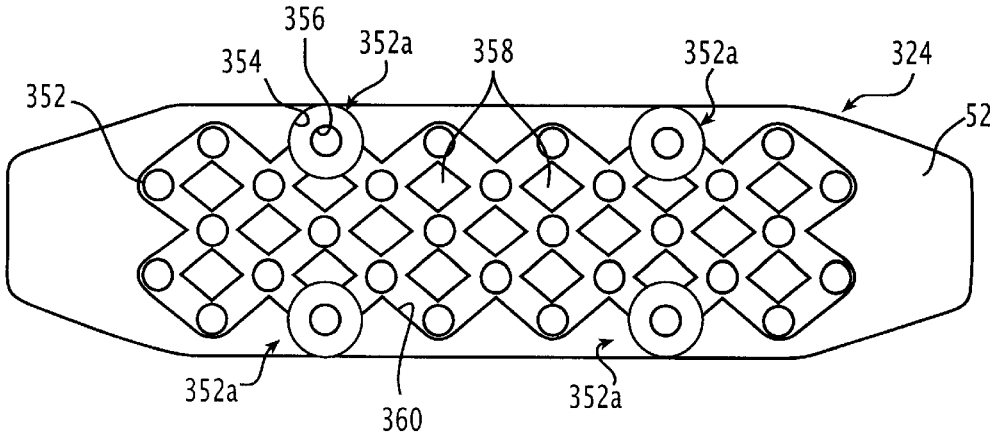
FIG. 12 is an enlarged, back view of another embodiment of the insert for use with the club head shown in FIG. 9A.

Referring to FIG. 12, the insert 324 is similar to the insert 224 shown in FIGS. 9–11, and for use with the club head shown in FIG. 9A. Similar portions of the insert 324 to the insert 224 begin the reference with a number "3" instead of "2". The back face 52 of the insert 324 further includes a continuous passageway 360 or a matrix. The passageway 360 connects each of the insert cavities 352 and 352*a*. The passageway is formed using conventional techniques so that the insert back face landings or areas 358 remain between portions of the passageway. In this embodiment, the depth of the passageway 360 does not equal the depth of the cavities 352 so the cavities 352 remain after the passageway is formed.

The front of the insert 324 is similar to that shown in FIG. 9 where the insert includes the flange and the platform portion. The counterbored portions 354 form apertures 351 and *b* in the flange. The insert 324 is fastened within the club head as discussed previously.

Once the insert 324 is disposed in a club head, the passageway from the groove 54 to the apertures 244 is formed by each aperture 351 in the flange and the associated cavities 352*a* with the counterbores. The vibration dampening material 46 is disposed within the groove 54, the apertures 351 in the flange, the cavities 352, and the apertures 44 and 244. The vibration dampening material 46 is continuous from the strike face 22 to the back face portion 42.

In this embodiment, the portion of the insert forming the counterbores and cavities is spaced from the bottom surface of the recess. The remaining portion of the insert 324 (i.e., the landings 358 and the remaining area of the back face 52) is in contact with the bottom surface of the recess. This is metal-to-metal contact. The continuous passageway 360 provides a more pronounced vibration dampening feature than the embodiment disclosed in FIG. 10 since the amount of metal-to-metal contact will be decreased using the insert 324 versus the insert 224.

In another embodiment, the back face of the insert can be modified so that the cavities have a different shape and/or the passageway connects the cavities in a different arrangement. Furthermore, the location and number of the apertures and cavities can be varied while still providing the passageway as desired. In addition, the passageway can be continuous through the cavities so that separate lines or shapes are formed by the back face passageway.

Figure 13:
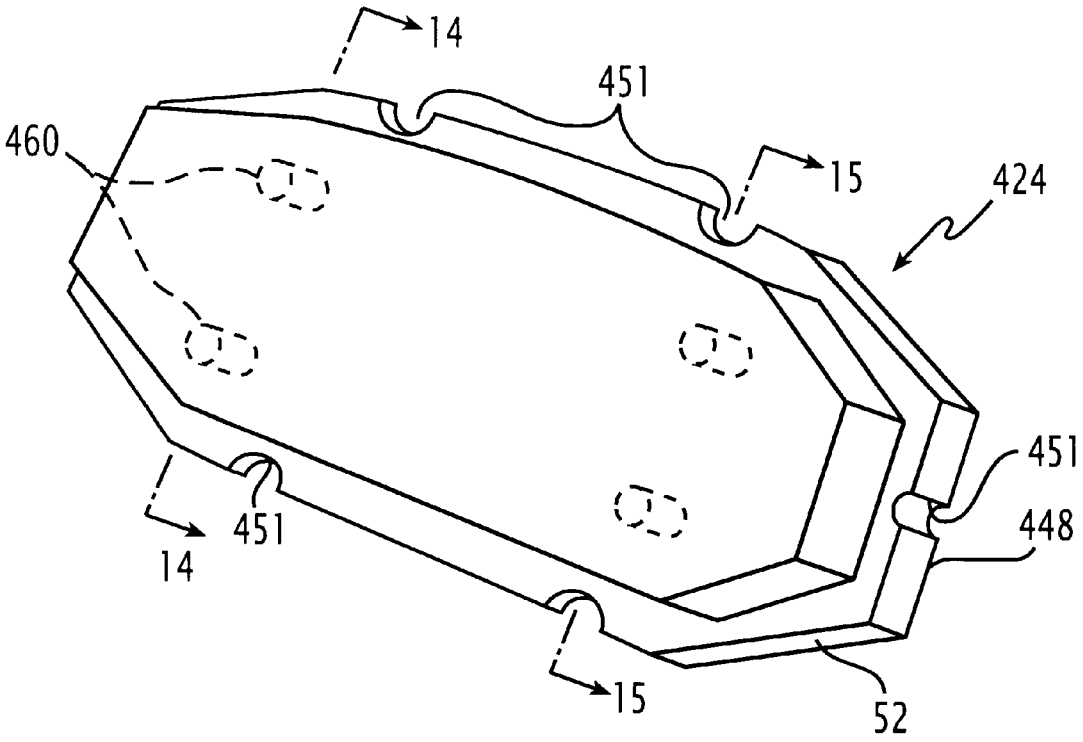
FIG. 13 is an enlarged perspective view of another embodiment of the insert for use with the club head shown in FIGS. 1–4.

Referring to FIG. 13, the insert 424 is for use with a club head similar to that shown in FIG. 9A, and includes a flange 448 similar to that shown in FIG. 6. However, the flange 448 defines a plurality of circumferentially spaced notches 451. However, the back face 52 of the insert 424 further includes a plurality of projections 460 (shown in phantom) extending therefrom at spaced locations. The insert 424 is fastened within the club head as discussed previously.

Figure 14:
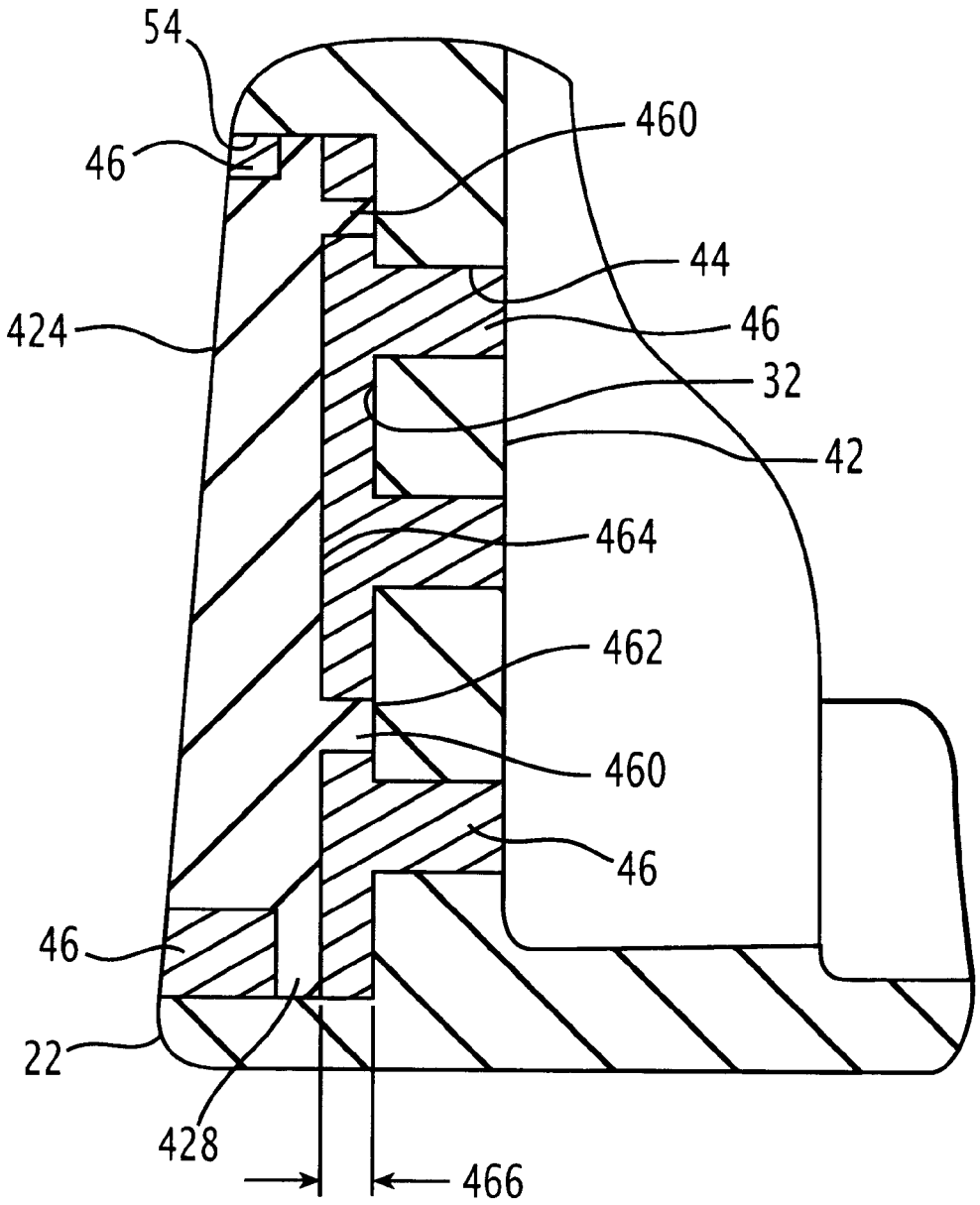
FIG. 14 is a cross-sectional view along the line 14—14 of FIG. 13 showing the insert of FIG. 13 assembled in a club head and the vibration dampening material therein.
Figure 15:
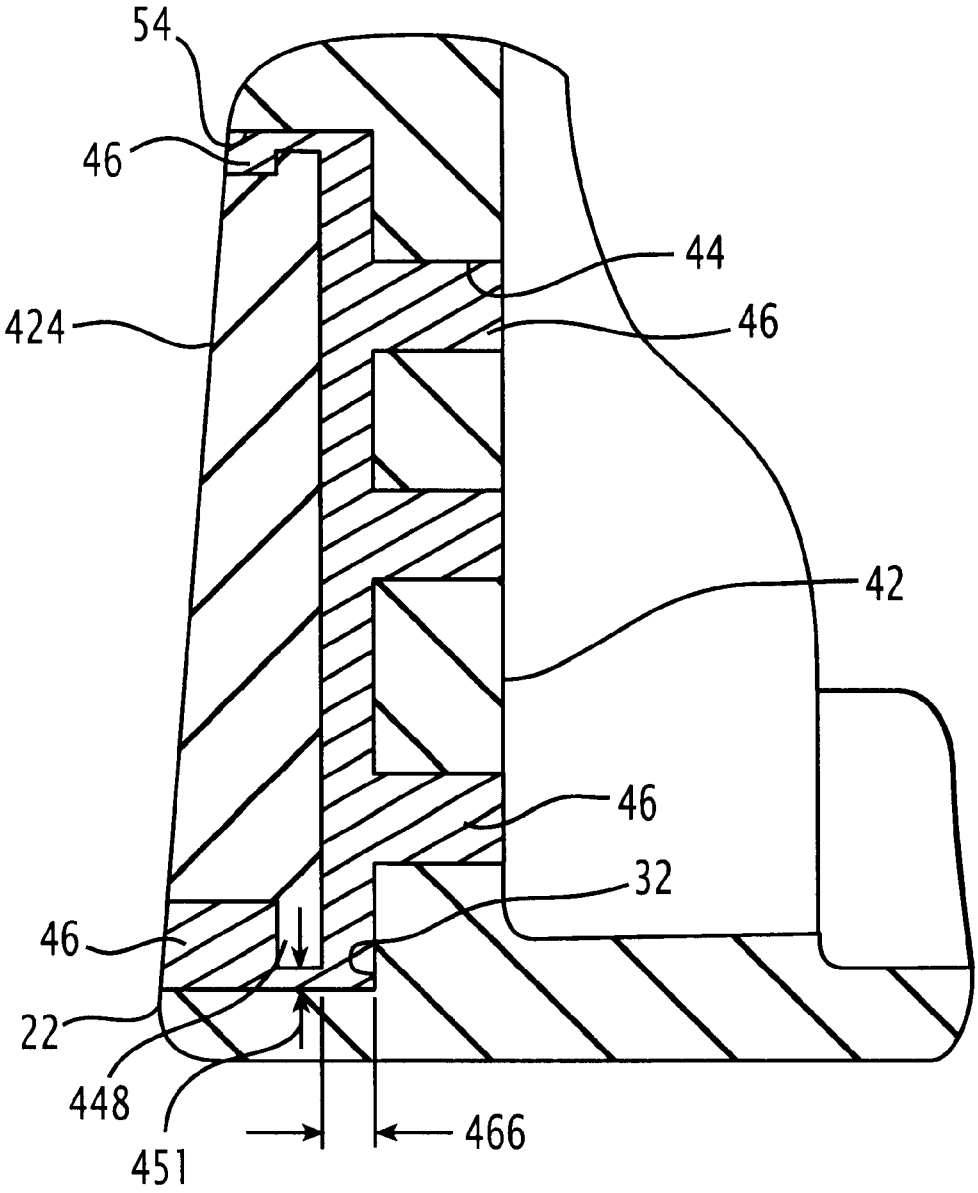
FIG. 15 is a cross-sectional view along the line 15—15 of FIG. 13 showing the insert of FIG. 13 assembled in a club head and the vibration dampening material therein.

Referring to FIGS. 14 and 15, when the insert 424 is disposed within the recess 30, the free ends 462 of the projections 460 are portions of the back face that are in contact with the bottom surface 32 of the recess 30. The remaining portion 464 of the back face is spaced from the bottom of the recess so that a gap 466 is defined there between. The vibration dampening material 46 within the gap 466 is in fluid communication with the vibration dampening 46 material within the apertures 44. Referring to FIG. 15, the notches or apertures 451 define passageways between the groove 54 and the gap 466 and the apertures 44. The vibration dampening material 46 is continuous from the strike face 22 to the back face portion 42.

In this embodiment, the projections 460 provide metal-to-metal contact between the insert and the recess 30. A club head with the insert 424 exhibits a different touch and feel than a club head with a similarly configured insert which does not have projections but defines a gap between the back face of the insert and the recess bottom. Co-pending application Ser. No. 09/220,083, filed Dec. 23, 1998 discloses such a club head in FIGS. 15, 16, 23–26 and the associated specification language. In addition, co-pending application Ser. No. 08/711,337, filed Sep. 6, 1996 discloses such a club head in FIGS. 15 and 16 and the associated specification language. The gap 466 may provide a more pronounced vibration dampening feature than the embodiment disclosed in FIGS. 1–12, since the amount of metal-to-metal contact will be decreased using the gap.

Figure 16:
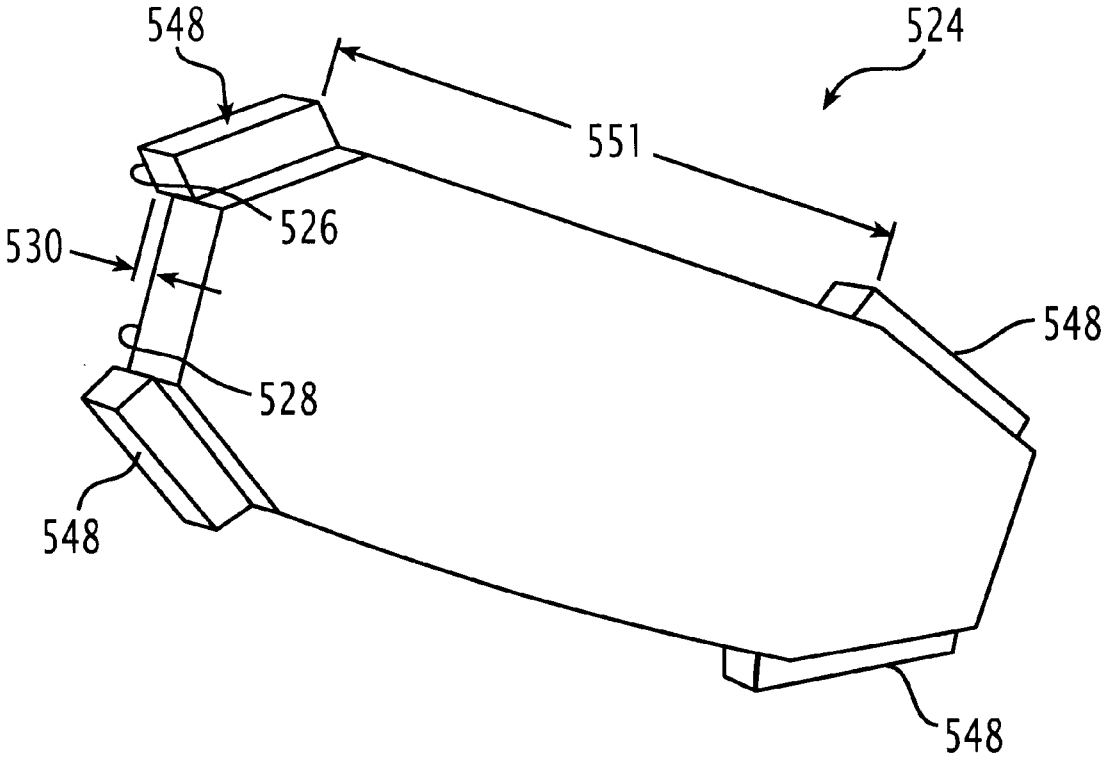
FIG. 16 is an enlarged, front perspective view of another embodiment of the insert for use with the club head shown in FIGS. 1–4.

Referring to FIG. 16, the insert 524 is for use with a club head similar to that shown in FIG. 9A. The insert 524 is similar to the insert 24 shown in FIG. 3. However, the projections 548 have an increased thickness so that the portion 526 of the back face of each projection is spaced from the remaining portion 528 of the back face. Thus, the projection back face portion 526 is spaced a distance 530 from the remaining portion 528. When the insert 524 is disposed in a club head similar to that described in FIG. 3, the portions 526 are in contact with the bottom surface 32 of the recess 30. The remaining portion 528 of the back face is spaced from the bottom of the recess so that a gap similar to the gap 466 (shown in FIGS. 14 and 15) is defined there between. The vibration dampening material 46 within the gap is in fluid communication with the vibration dampening material within the apertures 44. Similarly to FIG. 15, the spaces 551 between the projections 548 define passageways between the groove 54 and the gap and the apertures 44. The vibration dampening material 46 is continuous from the strike face 22 to the back face portion 42.

In this embodiment, the projections 548 provide metal-to-metal contact between the insert and the recess 30. A club head with the insert 524 exhibits a different touch and feel than a club head with a similarly configured insert which does not have projections but defines a gap between the back face of the insert and the recess bottom, as discussed above.

In another embodiment, the back face of the inserts 424 and 524 can be modified to include notches of different sizes, locations, and shapes. Furthermore, the back faces can include cavities, counterbored portions and passageways as discussed above.

In another embodiment, the various portions of the golf club head can be filled with two or more different vibration dampening materials. For example, foam rubber or another elastomeric material can be used.

During manufacture, depending on the configuration of the insert and the apertures, in order to introduce the elastomeric material into the club head, it is injected into the apertures and it may flow from the back face portion to the strike face. The configuration may require that the material is injected in the groove and the apertures so that the material will be continuous from the back face portion to the strike face. A squeegee is scraped across the back face portion and the strike face to remove the excess silicone, leaving the silicone in each of the apertures and the groove.

The amount of vibration dampening material in the club head can be varied in a number of ways. For example, the number of apertures or number of apertures filled with the vibration dampening material can be varied. In addition, the geometry of the peripheral groove can be varied by changing the width w (as shown in FIG. 1), by changing the depth D (as shown in FIG. 5), by changing the geometry of the flange or projections, or by changing the size of the gap.

Varying the amount of vibration dampening material affects the feel of the club head and allows the club head to be custom fit to a particular player or group of players depending on their needs, preferences, and/or performance. If a player, such as a Tour player, prefers more metal-to-metal contact between the insert and recess bottom surface, the amount of vibration dampening material can be decreased. If as a group, ladies, seniors or juniors, for example, prefer less metal-to-metal contact the amount of vibration dampening material can be increased. Thus, the club head of the present invention allows the manufacturer to modify the club head to satisfy one player or a group of players, which is advantageous.

We claim:

1. A golf club head having a toe and an opposite heel, a sole portion and an opposite top portion, a forwardly facing exposed strike face and an opposite rearwardly facing exposed back face portion, comprising:

a) a recess defined in the strike face;

b) an insert located in the recess, forming a first portion of the strike face, and the insert further including a back face; and c) a vibration dampening material extending continuously from the strike face to the back face portion, the vibration dampening material forming a second portion of the strike face.

2. The golf club of claim 1, wherein recess has a bottom surface and insert includes a back face in contact with the bottom surface.

3. A golf club head having a toe and an opposite heel, a sole portion and an opposite top portion, a forwardly facing exposed strike face and an opposite rearwardly facing exposed back face portion, comprising:

a) a recess defined in the strike face, said recess having a bottom surface spaced from the back face portion;

b) an insert located in the recess, said insert having a first portion, a second portion, and a back face, the first portion including a front surface spaced from the strike face and disposed between strike face and the bottom surface of the recess, and a first passageway extending from the front surface to the back face of the insert; the second portion forms a portion of the strike face; and c) a vibration dampening material located in the passageway.

4. The golf club head of claim 3, wherein the recess further including a side wall surface extending between the bottom surface and the strike face, said second portion including a peripheral edge spaced from the side wall surface to form a peripheral groove on the strike face, and the vibration dampening material located in the groove.

5. The golf club head of claim 4, further including a first aperture extending from said back face portion to the bottom surface, the vibration dampening material located in the first aperture, wherein the vibration dampening material is continuous from the strike face to the back face portion through the groove, the first passageway, and the first aperture.

6. The golf club head of claim 5, wherein the first passageway includes a second aperture unaligned with the first aperture.

7. The golf club head of claim 5, wherein the first passageway includes a second aperture at least partially aligned with the first aperture.

8. The golf club head of claim 5, wherein the first passageway includes a second aperture completely aligned with the first aperture.

9. The golf club head of claim 6, wherein the passageway further including a cutout in the back face extending from the second aperture to the first aperture.

10. The golf club head of claim 9, wherein the back surface of the insert further including a cavity aligned to be complementary with the first aperture, the cutout extending from the second aperture to the cavity, and the vibration dampening material extending into said insert cavity.

11. The golf club head of claim 4, wherein the first portion extending radially outwardly from the second portion, and the first portion is in contact with a portion of the side wall surface.

12. The golf club head of claim 4, further including a first plurality of apertures extending from said back face portion to the bottom surface, the first passageway for fluid communication between the groove and a group of the first plurality of apertures; and the vibration dampening material located in the groove, the first plurality of apertures and the first passageway, wherein the vibration dampening material is continuous from the strike face to the back face portion.

13. The golf club head of claim 12, wherein the passageway includes a plurality of second apertures unaligned with the first plurality of apertures.

14. The golf club head of claim 13, wherein the passageway further including a cutout in the back face extending from the second plurality of apertures to the group of the first plurality of apertures.

15. The golf club head of claim 13, wherein the back face of the insert further including a plurality of cavities aligned to be complementary with the first plurality of apertures, the cutout extending from the second plurality of apertures to a group of the cavities, and the vibration dampening material extending into said insert cavities.

16. The golf club head of claim 15, wherein each cavity in the group of cavities has a counterbored portion which forms the cutout.

17. The golf club of claim 15, wherein the insert back face further comprises:

a) a continuous second passageway connecting each of said insert cavities; and b) the vibration dampening material extending through the continuous second passageway.

18. The golf club head of claim 17, wherein the first portion is a peripheral flange extending around the second portion, and each of the second plurality of apertures extending from the flange front surface to the back surface.

19. The golf club head of claim 18, wherein said second plurality of apertures is formed by the counterbored portion of the insert cavities.

20. The golf club of claim 19, wherein the insert back face further comprises:

a) a continuous passageway connecting each of said insert cavities; and b) the vibration dampening material extending through the continuous passageway.

21. A golf club head having a toe and an opposite heel, a sole portion and an opposite top portion, a forwardly facing exposed strike face and an opposite rearwardly facing exposed back face portion, comprising:

a recess defined in the strike face, said recess having a bottom surface spaced from the back face portion;

an insert located in the recess, said insert further including a back face, and the insert having a first portion of the back face spaced from said bottom surface of the recess to define a gap between the first portion and the recess bottom surface, and the insert further includes a second portion of the back face in contact with the recess bottom surface; and c) a vibration dampening material located in the gap, wherein the recess further including a side wall surface extending between the bottom surface and the strike face, the second portion including a peripheral edge spaced from the side wall surface to form a peripheral groove on the strike face, and the vibration dampening material located in the groove.

22. The golf club head of claim 21, further including a first aperture extending from said back face portion to the bottom surface, the vibration dampening material located in the first aperture, wherein the vibration dampening material is continuous from the strike face to the back face portion.

23. The golf club head of 21, wherein the insert further including a plurality of radially extending peripheral projections, and the projections include the second portion of the back face.

24. The golf club head of claim 21, wherein said insert further includes at least one projection extending from the first portion of the back face, the projection including the second portion of the back face at a free end.

25. The golf club of claim 3, wherein the entire back face of the insert contacts the bottom surface of the recess.

26. A golf club head having a toe and an opposite heel, a sole portion and an opposite top portion, a forwardly facing exposed strike face and an opposite rearwardly facing exposed back face portion, comprising:

a) a recess defined in the strike face, said recess having a bottom surface spaced from the back face portion and a side wall surface extending between the bottom surface and the strike face;

b) an insert located in the recess, said insert having a peripheral edge spaced from the side wall surface to form a peripheral groove, and a first vibration dampening material located in the peripheral groove, the insert further including a back face having at least one portion of the back face in contact with the bottom surface of the recess, and c) a plurality of apertures extending from said back face portion toward the recess and a second vibration dampening material located in at least one of said apertures, wherein the first vibration dampening material is in communication with the second vibration dampening material.

* * * * *